US005396953A

United States Patent [19]

Holder et al.

[11] Patent Number: 5,396,953

[45] Date of Patent: Mar. 14, 1995

[54] POSITIVE CIRCULATING VALVE WITH RETRIEVABLE STANDING VALVE

[75] Inventors: Barry K. Holder, Odessa, Tex.; Steven L. Schwegman, Duncan, Okla.; Lawrence J. Leger, Sugarland, Tex.

[73] Assignee: Halliburton Company, Duncan, Okla.

[21] Appl. No.: 99,877

[22] Filed: Jul. 30, 1993

[51] Int. Cl.[6] ..... E21B 33/00

[52] U.S. Cl. ..... 166/129; 166/183; 166/331

[58] Field of Search ..... 166/126, 129, 142, 183, 166/331

[56] References Cited

U.S. PATENT DOCUMENTS

| | | | |
|---|---|---|---|
| 3,554,281 | 1/1971 | Ecuer | 166/318 X |
| 3,664,427 | 5/1972 | Denton | 166/313 |
| 3,680,637 | 8/1972 | Raulins | 166/313 |
| 4,569,396 | 2/1986 | Brisco | 166/305.1 |
| 4,590,995 | 5/1986 | Evans | 166/127 |
| 5,048,611 | 9/1991 | Cochran | 166/321 X |
| 5,168,931 | 12/1992 | Caskey et al. | 166/332 |
| 5,253,712 | 10/1993 | Swor | 166/330 |

OTHER PUBLICATIONS

Halliburton Sales & Service Catalog No. 43 (1985), pp. 2563–2564, 2573 and 2568–2569.

*Primary Examiner*—William P. Neuder

*Attorney, Agent, or Firm*—Stephen R. Christian; Neal R. Kennedy

[57] ABSTRACT

A positive circulating valve with a retrievable standing valve therein. The valve is used with a packer positioned therebelow. The circulating valve comprises a housing with a mandrel slidably disposed therebetween. A J-slot controls movement between open and closed positions. When in the open position, mandrel ports in the mandrel are aligned with body ports in the housing so that bypassing and circulating may be carried out. The standing valve prevents fluid flow downwardly through the tool string below the circulating valve when the circulating valve is in the open position. When the circulating valve is in a closed position, the mandrel ports are in communication with a central opening through the housing, allowing fluid to be pumped downwardly through the circulating valve. The standing valve may be removed so that the circulating valve has a substantially unrestricted flow path therethrough for high flow rate fracturing jobs and the like.

20 Claims, 2 Drawing Sheets

POSITIVE CIRCULATING VALVE WITH RETRIEVABLE STANDING VALVE

BACKGROUND OF THE INVENTION

1. Field of the Invention

This invention relates to circulating valves used in testing and pumping operations in a wellbore, and more particularly, to a circulating valve with a standing valve for preventing fluid loss to a well formation when a packer is set therebelow with the circulating valve in the open position.

2. Description of the Prior Art

The Halliburton retrievable test-treat-squeeze (RTTS) packer system includes a multi-purpose hook wall-type retrievable packer designed for use in testing, treating and squeezing operations in a wellbore. The system also includes a two-position circulating valve.

The packer is set by apploying right-hand torque to the tool string and setting down weight. This action causes mechanical slips in the packer to engage the wall of the casing. These slips then support the tubing weight required to compress rubber packer elements to cause them to seal against the casing. The mechanical slips also support any hydraulic load in the well annulus above the packer, such as when the tubing is swabbed.

A hydraulic hold-down with large slips is built into the packer above the packer elements. These hydraulic slips engage the casing only when pressure is applied through the tubing to the area below the packer to resist any upward movement of the packer due to the force created by the pressure thereunder.

During pumping and testing operations of the tool, the circulating valve is locked closed. When desired, it may be opened to allow circulating above the packer and later reclosed.

Both the packer and circulating valve have large bores therethrough which permit the pumping of large volumes of liquid with a minimum pressure drop. A problem may arise when it is not desirable to place a large volume of fluid on the well formation prematurely. Some formations cannot handle the weight of the fluid, and the fluid may be lost by dissipation through the formation.

The circulating valve of the present invention solves this problem by modifying the prior art valve to provide a removable standing valve therein. The standing valve is similar to that used in the Halliburton Pin Point Injection (PPI) Packer. The standing valve keeps hydrostatic head off the formation before fracturing treatment to prevent fluid loss to the formation.

The circulating valve also acts as a positive circulating valve with a forced flow path through which chemicals, such as acid, may be spotted. For example, a very small amount of acid may be spotted through the tubing to clean out scale.

After this operation, the standing valve may be removed by a retrievable tool on a wireline, and subsequently, the circulating valve may be operated at high flow rates to conduct normal fracturing/treating jobs in the same manner as the prior art RTTS circulating valve.

After the treatment has been performed, the standing valve may be returned to its position in the circulating valve. The circulating valve may then be opened, and the annular fluid above the packer may be recovered without losing it to the formation.

SUMMARY OF THE INVENTION

The positive circulating valve of the present invention is adapted for use in a wellbore on a tool string. The circulating valve comprises mandrel means for connecting to the tool string with the mandrel means defining a mandrel central opening therethrough and a mandrel port in communication with the mandrel central opening, housing means for slidably receiving at least a portion of the mandrel means therein with the housing means defining a housing port therein, sealing means for sealing between the mandrel means and housing means, and a standing valve disposed in the mandrel central opening of the mandrel means. The mandrel means is movable between an open position in which the mandrel port is on one side of the sealing means and in communication with the housing port and a closed position in which the mandrel port is on an opposite side of the sealing means. The standing valve is adapted for substantially preventing fluid flow downwardly through the mandrel means and for allowing fluid flow upwardly through the mandrel means.

The housing means defines a housing central opening therethrough, and the mandrel port is in communication with at least a portion of the housing central opening when the mandrel means is in the closed position. In this closed position, a relatively low flow rate of fluid may be pumped downwardly through the circulating valve. When the circulating valve is in the open position, the standing valve prevents substantially any fluid flow downwardly through the circulating valve.

The mandrel means preferably has a valve seat positioned at a lower end thereof with the standing valve being adapted for engagement with the valve seat. The standing valve is removable from the valve seat, and a sealing means is disposed on the standing valve for sealingly engaging an inner surface of the valve seat. The standing valve has a chamfered surface engaging another chamfered surface on the valve seat. This engagement limits downward movement of the standing valve with respect to the valve seat.

The standing valve has a retrieving neck thereon which is adapted for receiving a retrieving overshot or tool of a kind known in the art. In this way, the standing valve may be removed from the circulating valve.

The circulating valve further comprises J-slot means for controlling movement of the mandrel means with respect to the housing means between the open and closed positions.

The invention may be additionally described as a downhole tool comprising a circulating valve adapted for connection to a tool string and having an open position and a closed position, and a packer disposed below the circulating valve. The circulating valve of the tool comprises a standing valve for preventing downward flow of fluid when the circulating valve is in the open position, allowing upward fluid flow through the circulating valve, and allowing downward fluid flow through the circulating valve when the circulating valve is in the closed position. A setting operation for the packer also results in movement of the circulating valve from the open position to the closed position.

The open position of the circulating valve may be used for bypassing fluid as the tool is run into the wellbore and for circulating fluid through the tool string once it is in the desired position. After setting the packer, and closing the valve to circulation, some fluid may be pumped downwardly through the circulating valve, e.g., spotting a small amount of acid to clean out scale in the tubing and tool. By removing the standing valve, a full flow fracturing job may be carried out.

In the tool, the circulating valve may comprise a valve J-slot therein for controlling actuation of the circulating valve between the open and closed positions thereof, the packer may comprise a packer J-slot therein, and the valve and packer J-slots may be substantially simultaneously actuated when the packer is set.

Numerous objects and advantages of the invention will become apparent as the following detailed description of the preferred embodiment is read in conjunction with the drawings which illustrate such embodiment.

DESCRIPTION OF THE PREFERRED EMBODIMENT

Figure 1:
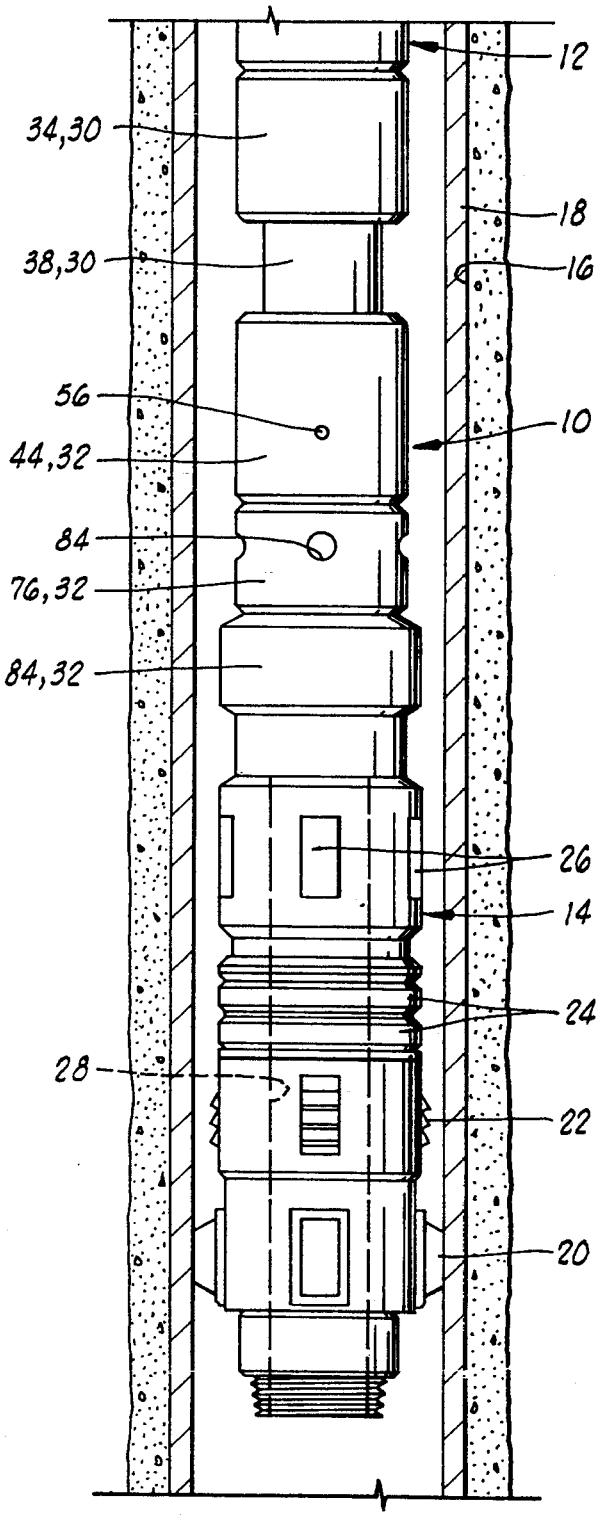
FIG. 1 illustrates the circulating valve with retrievable standing valve as it is run into a wellbore with a packer.

Referring now to the drawings, and more particularly to FIG. 1, the positive circulating valve with retrievable standing valve of the present invention is shown and generally designated by the numeral 10. Circulating valve 10 is part of a tool string 12 which also includes a packer of a kind known in the art, such as the Halliburton retrievable test-treat-squeeze (RTTS) packer.

In FIG. 1, tool string 12 is shown as it is lowered into a wellbore 16 having casing 18 disposed therein.

Generally, packer 14 includes guide blocks 20 which guide the lower end of tool string 12 through casing 18, mechanical slips 22 used lock the packer in the casing when set, packer elements 24 which sealingly engage casing 18 when the packer is set, and a plurality of hydraulic slips 26. Packer 14 defines a central opening or bore 28 therethrough which is relatively large and permits the pumping of large volumes of fluid with a minimum pressure drop through the packer.

Figure 2A:
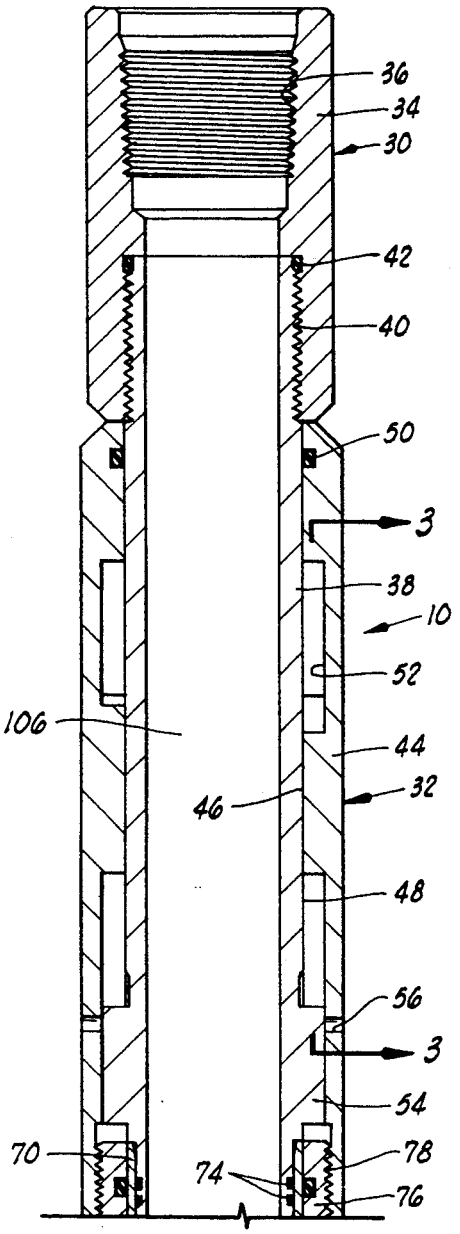
FIGS. 2A and 2B show a longitudinal cross section of the circulating valve.
Figure 2B:
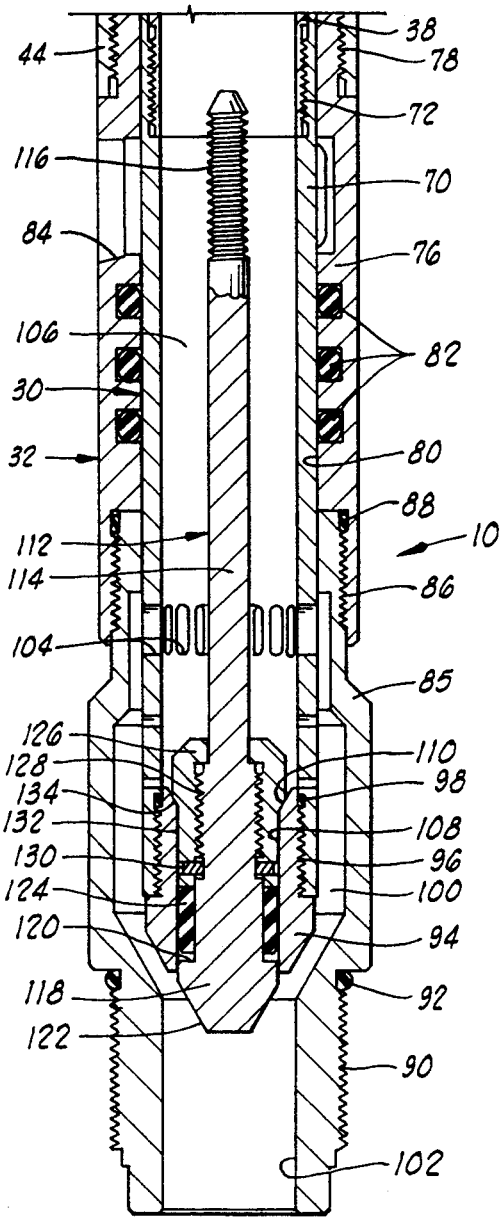

Referring now to FIGS. 2A and 2B, the details of circulating valve 10 will be discussed. Circulating valve 10 generally comprises a mandrel means 30 for connecting to tool string 12 and a housing means 32 for slidably receiving a portion of mandrel means 30 therein.

At the upper end of mandrel means 30 is a top adapter 34 having an internally threaded surface 36 therein which is adapted to be threadingly engaged with tool string 12.

Top adapter 34 is connected to a lug mandrel 38 at threaded connection 40. Thus, lug mandrel 38 is part of mandrel means 30. A sealing means, such as O-ring 42, provides sealing engagement between top adapter 34 and lug mandrel 38.

Housing means 32 comprises a J-slot sleeve or body 44 defining a longitudinal bore 46 therethrough. An outside diameter 48 of lug mandrel 38 is slidably received in bore 46. A sealing means, such as O-ring 50, provides sliding, sealing engagement between lug mandrel 38 and J-slot sleeve 44.

J-slot sleeve 44 defines a J-slot 52 therein, and lug mandrel 38 has a radially outwardly extending lug 54 which extends into, and engages, J-slot 52. A pressure equalizing port 56 insures that the pressure in J-slot 52 is equalized with the pressure in the well annulus outside circulating valve 10.

Figure 3:
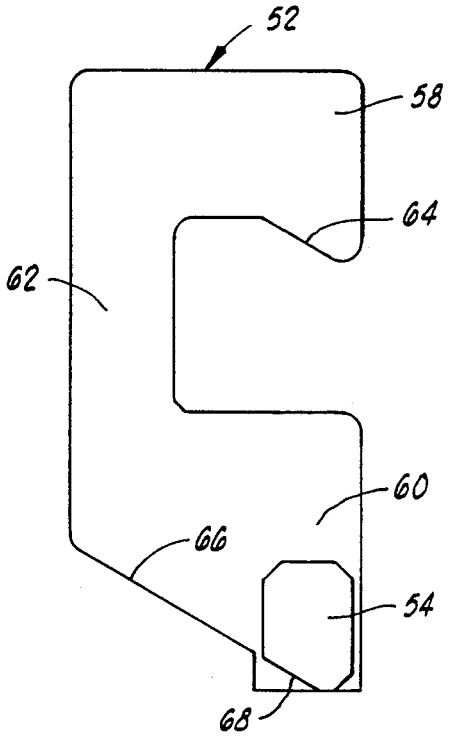
FIG. 3 is a view of a J-slot taken along lines 3—3 in FIG. 2A.

Referring now to FIG. 3, the shape of J-slot 52 is shown. J-slot 52 has an upper section 58 and a lower section 60 interconnected by a transition section 62. Upper section 58 has a slanted wall or surface 64, and another slanted wall or surface 66 extends from transition section 62 to lower section 60 of J-slot 52. Lug 54 has a slanted surface 68 thereon which is adapted for engagement with walls 64 and 66.

Lug 54 is illustrated in lower section 60 of J-slot 52 in FIG. 3. As will be further discussed herein, when lug 54 is in upper section 58 of J-slot 52, circulating valve 10 is in its open position, which may also be referred to as a bypass and/or circulating position. When lug 54 is in lower section 60 of J-slot 52, circulating valve 10 is closed with respect to bypassing and circulating and thus may be referred to as in a closed position.

Referring now to FIGS. 2A and 2B, the lower end of lug mandrel 38 is connected to ported mandrel 70 at threaded connection 72. Thus, ported mandrel 70 may be considered a part of mandrel means 30. A sealing means, such as O-rings 74, provides sealing engagement between lug mandrel 38 and ported mandrel 70.

The lower end of J-slot sleeve 44 is connected to a body or housing 76 at threaded connection 78. Body 76 is thus a part of housing means 32.

Body 76 defines a central opening or bore 80 therethrough. Ported mandrel 70 is slidably received in bore 80. A sealing means, such as a plurality of seals 82, provides sliding, sealing engagement between body 76 and ported mandrel 70.

Body 76 defines a plurality of body or housing ports 84 therethrough which are in communication with bore 80.

The lower end of body 76 is connected to a lower body 85 at threaded connection 86. A sealing means, such as O-ring 88, provides sealing engagement between body 76 and lower body 85.

The lower end of lower body 85 has an externally threaded surface 90 thereon and which is adapted for threading engagement with packer 14 in a manner known in the art. A sealing means, such as O-ring 92, may be used to seal between circulating valve 10 and packer 14.

At the lower end of mandrel means 30, ported mandrel 70 is attached to a valve seat 94 at threaded connection 96. A sealing means, such as O-ring 98, provides sealing engagement between ported mandrel 70 and valve seat 94.

An annulus 100 is defined between the lower end of mandrel means 30 and lower body 85 of housing means 32. Annulus 100 is in fluid communication with a central opening 102 defined through the lower end of lower body 85.

A plurality of radially extending mandrel ports 104 are defined through ported mandrel 70. In the position shown in FIGS. 2A and 2B, it will be seen that mandrel ports 104 are in communication with annulus 100 and thus in communication with central opening 102. Mandrel ports 104 are also in communication with a central opening 106 defined through mandrel means 30, and it will thus be seen that when circulating valve 10 is in the position shown in FIGS. 2A and 2B, central opening 106 is in communication with central opening 102.

Valve seat 94 defines a bore 108 therethrough with a chamfer 110 at the upper end thereof.

A standing valve 112 is disposed in mandrel means 30 and is engaged with valve seat 94. Standing valve 112 comprises a stem portion 114 having an upper threaded end 116 adapted for connection with a retrieving overshot (not shown) of a kind known in the art.

Stem portion 114 has an enlarged lower end 118 defining an upwardly facing shoulder 120 thereon. Lower end 118 has a downwardly facing tapered surface which helps guide standing valve 112 into valve seat 94.

A sealing means, such as seal 124, is disposed around stem portion 114 adjacent to shoulder 120. Seal 124 is held in place by a seal retainer 126 which is attached to stem portion 114 at threaded connection 128. A locking means, such as a plurality of set screws 130, may be used to lock seal retainer 126 onto stem portion 114.

Seal retainer 126 has an outside diameter 132 which is adapted to slide within bore 108 of valve seat 94. Seal retainer 126 also has a downwardly facing chamfered surface 134 which is adapted for engagement with chamfer 110 on valve seat 94. Seal 124 is adapted to provide sealing engagement between stem portion 114 and bore 108 in valve seat 94 when standing valve 112 is in the position shown in FIG. 2B.

OPERATION OF THE INVENTION

In operation, circulating valve 10 is run into wellbore 16 on tool string 12 as previously described. Packer 14 is disposed below circulating valve 10. Before circulating valve 10 is run into wellbore 16, it is set in its open or bypass position. That is, lug 54 on lug mandrel 38 is positioned in upper portion 58 of J-slot 52. In this position, mandrel means 30 is extended with respect to housing means 32, and mandrel ports 104 are substantially aligned with body ports 84 in body 76. Surface 68 on lug 54 is adjacent to wall 64 in upper portion 58 of J-slot 52, and because the components are hanging from tool string 12, it will be seen that circulating valve 10 is locked in its bypass position.

As tool string 12 is run into wellbore 16, fluid is bypassed upwardly through central opening 28 in packer 14 and central opening 102 in lower body 85 of circulating valve 10. This upward bypassing of fluid forces standing valve 112 upwardly so that it is disengaged from valve seat 94, thereby allowing fluid to flow upwardly around the standing valve and into central opening 106 of mandrel means 30. It will thus be seen that the fluid then flows outwardly (bypasses) through aligned mandrel ports 104 and body ports 84.

After tool string 12 is positioned, fluid may be circulated through circulating valve 10. That is, since valve 10 is in its an open or circulating position, fluid may be pumped down through tool string 12 and circulated out into the well annulus through aligned mandrel ports 104 and body ports 84. Standing valve 112 prevents fluid flow downwardly through packer 14, and this prevents fluid pressure from being placed on the well formation prematurely. As previously indicated, this is particularly important when the formation cannot handle the weight of the fluid and application of fluid to the formation would result in the fluid being prematurely dissipated through the formation.

Once circulation is complete, packer 14 is set in a manner known in the art. For the Halliburton RTTS packer, this setting is carried out by applying right-hand torque to tool string 12 and setting down tubing weight. Mechanical slips 22 are thus lockingly engaged with casing 18 and packer elements 24 are sealingly engaged with the casing.

The right-hand torque applied to tool string 12 to set packer 14 is also applied to mandrel means 30 of circulating valve 10. This movement is substantially the same as the prior art circulating valve. Thus, lug 54 is moved from upper portion 58 of J-slot 52 toward transition portion 62 as a result of the right-hand torque and then moved downwardly through transition portion 62 into lower portion 60 when weight is set down on the tool. This moves mandrel means 30 in circulating valve 10 from the open position previously described to the closed or testing/treating position which is illustrated in FIGS. 2A and 2B.

In this position, some fluid may be spotted down tool string 12 through mandrel ports 104 into annulus 100 and central opening 102 and then through central opening 28 in packer 14 to clean out scale and/or inject chemicals, such as acid, into the well formation.

At this point, a retrieval tool is lowered through tool string 12 on a wireline, and this retrieval tool (not shown) is used to engage threaded end 116 of stem portion 114 of standing valve 112 so that the standing valve may be removed from circulating valve 10 and retrieved to the surface. Once standing valve 112 has been removed, circulating valve 10 is operated in the substantially identical manner to the prior art Halliburton RTTS valve. That is, a high flow rate fracturing job may be carried out, along with subsequent testing of the well formation and reversing of fluid after the packer is unset in a manner known in the art.

After the fracturing treatment has been performed, standing valve 112 may be lowered back down tool string 12 and repositioned in circulating valve 10. Then, by lifting and applying left-hand torque to tool string 12, circulating valve 10 may be reopened, and the annular fluid above packer 14 may be recovered through circulating valve 10 and tool string 12 without losing it to the formation below the set packer.

It will be seen therefore, that the positive circulating valve with retrievable standing valve therein of the present invention is well adapted to carry out the ends and advantages mentioned, as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A circulating valve for use in a wellbore, said circulating valve comprising:

mandrel means for connecting to a tool string, said mandrel means defining a mandrel central opening therethrough and a mandrel port in communication with said mandrel central opening;

housing means for slidably receiving at least a portion of said mandrel means therein, said housing means defining a housing port therein;

sealing means for sealing between said mandrel means and said housing means, wherein said mandrel means is movable between an open position in which said mandrel port is on one side of said sealing means and in communication with said housing port and a closed position in which said mandrel port is on an opposite side of said sealing means; and a standing valve disposed in said mandrel central opening of said mandrel means for substantially preventing fluid flow downwardly through said mandrel means and for allowing fluid flow upwardly through said mandrel means.

2. The valve of claim 1 wherein:

said mandrel means has a valve seat positioned at a lower end thereof; and said standing valve is adapted for engagement with said valve seat.

3. The valve of claim 2 wherein said standing valve is removable from said valve seat.

4. The valve of claim 2 further comprising sealing means disposed on said standing valve for sealingly engaging an inner surface of said valve seat.

5. The valve of claim 2 wherein said standing valve has a surface engaging another surface on said valve seat and thereby limiting downward movement of said standing valve with respect to said valve seat.

6. The valve of claim 1 wherein said standing valve has a retrieving neck thereon.

7. A downhole tool comprising:

a circulating valve adapted for connection to a tool string and having an open position and a closed position, said circulating valve comprising:

a standing valve for preventing downward flow of fluid when said circulating valve is in said open position, and allowing upward fluid flow through said circulating valve, wherein downward fluid flow is allowed through said circulating valve and around said standing valve when said circulating valve is in said closed position; and a packer disposed below said circulating valve, wherein setting of said packer results in movement of said circulating valve from said open position to said closed position.

8. The tool of claim 7 wherein said circulating valve further comprises:

a mandrel connectable to the tool string and defining a mandrel central opening therethrough and further defining a mandrel port in communication with said mandrel central opening, said mandrel comprising a valve seat therein, wherein said standing valve is positioned adjacent to said valve seat; and a housing adapted for slidably receiving at least a portion of said mandrel and being further adapted for connection to said packer.

9. The tool of claim 8 wherein said mandrel and said housing define an annulus therebetween which is in communication with said packer, said mandrel port being in communication with said annulus when said circulating valve is in said closed position.

10. The tool of claim 9 further comprising sealing means disposed above said annulus for sealing between said mandrel and housing.

11. The tool of claim 8 wherein said housing defines a housing port therethrough, said housing port being in communication with said mandrel port when the circulating valve is in said open position.

12. The tool of claim 11 further comprising sealing means disposed below said housing port for sealing between said mandrel and housing.

13. The apparatus of claim 8 further comprising sealing means for sealing between said standing valve and said valve seat.

14. The tool of claim 7 wherein said standing valve is adapted for engagement by a retrieving tool such that the standing valve may be removed from the circulating valve, thereby placing a central opening in said mandrel in communication with said packer.

15. The tool of claim 7 wherein:

said circulating valve has a valve J-slot therein for controlling actuation of the circulating valve between the open and closed positions thereof;

said packer has a packer J-slot therein; and said valve and packer J-slots are substantially simultaneously actuated when said packer is set.

16. The tool of claim 7 wherein downward movement of said standing valve is limited.

17. The tool of claim 16 wherein said standing valve is adapted for engagement with a seat surface in said circulating valve.

18. The tool of claim 7 wherein said packer and circulating valve are retrievable.

19. A circulating valve for use in a wellbore, said circulating valve comprising:

mandrel means for connecting to a tool string, said mandrel means defining a mandrel central opening therethrough and a mandrel port in communication with said mandrel central opening;

housing means for slidably receiving at least a portion of said mandrel means therein, said housing means defining a housing port therein, and said housing means defining a housing central opening therethrough;

sealing means for sealing between said mandrel means and said housing means, wherein said mandrel means is movable between an open position in which said mandrel port is on one side of said sealing means and in communication with said housing port and a closed position in which said mandrel port is on an opposite side of said sealing means, and said mandrel port is in communication with at least a portion of said housing central opening when said mandrel means is in said closed position; and a standing valve disposed in said mandrel central opening of said mandrel means for substantially preventing fluid flow downwardly through said mandrel means and for allowing fluid flow upwardly through said mandrel means.

20. A circulating valve for use in a wellbore, said circulating valve comprising:

mandrel means for connecting to a tool string, said mandrel means defining a mandrel central opening therethrough and a mandrel port in communication with said mandrel central opening;

housing means for slidably receiving at least a portion of said mandrel means therein, said housing means defining a housing port therein;

sealing means for sealing between said mandrel means and said housing means, wherein said mandrel means is movable between an open position in which said mandrel port is on one side of said sealing means and in communication with said housing port and a closed position in which said mandrel port is on an opposite side of said sealing means;

J-slot means for controlling movement of said mandrel means with respect to said housing means between said open and closed positions; and a standing valve disposed in said mandrel central opening of said mandrel means for substantially preventing fluid flow downwardly through said mandrel means and for allowing fluid flow upwardly through said mandrel means.

* * * * *